US005711161A

United States Patent [19]

Gustafson

[11] Patent Number: 5,711,161

[45] Date of Patent: Jan. 27, 1998

[54] BYPASS REFRIGERANT TEMPERATURE CONTROL SYSTEM AND METHOD

[75] Inventor: Alan D. Gustafson, Eden Prairie, Minn.

[73] Assignee: Thermo King Corporation, Minneapolis, Minn.

[21] Appl. No.: 665,117

[22] Filed: Jun. 14, 1996

[51] Int. Cl.[6] ..... F25B 41/00; F25B 39/04

[52] U.S. Cl. ..... 62/197; 62/217; 62/509

[58] Field of Search ..... 62/217, 197, 509

[56] References Cited

U.S. PATENT DOCUMENTS

| | | | |
|---|---|---|---|
| 4,335,742 | 6/1982 | Jacyno | 62/217 X |
| 4,550,574 | 11/1985 | Hohman . | |
| 4,694,660 | 9/1987 | Gunnaway . | |
| 4,832,068 | 5/1989 | Wendschlag et al. . | |
| 4,986,084 | 1/1991 | Beckhusen . | |

FOREIGN PATENT DOCUMENTS

| | | | |
|---|---|---|---|
| 0127052 | 10/1979 | Japan | 62/197 |
| 2187564 | 7/1990 | Japan | 62/197 |

*Primary Examiner*—William E. Wayner

[57] ABSTRACT

Both a system and method are provided for achieving temperature control in a refrigeration circuit by providing a bypass flow of saturated, gaseous refrigerant from the receiver tank to a point in the circuit downstream of the evaporator coil. The system includes a bypass conduit for conducting a bypass flow of saturated, gaseous refrigerant from an upper portion of the receiver tank to a point in the circuit between the evaporator coil and a suction line throttling valve to partially offset the cooling of the evaporator coil from the expansion valve. The bypass conduit includes a valve mechanism for modulating this flow to achieve a desired temperature setpoint. The system also includes a temperature monitoring sensor located in a space conditioned by the refrigeration circuit, as well as a microprocessor. The input of the microprocessor receives an electrical signal generated by the monitoring sensor indicative of the temperature of the space. The output of the microprocessor is connected to the valve mechanism in order to modulate the flow of bypass refrigerant to achieve a desired temperature setpoint in the conditioned space.

12 Claims, 1 Drawing Sheet

BYPASS REFRIGERANT TEMPERATURE CONTROL SYSTEM AND METHOD

BACKGROUND OF THE INVENTION

This invention generally relates to temperature control techniques for refrigeration systems, and is specifically concerned with a bypass system and method that routes saturated refrigerant from the upper part of the receiver tank to a point downstream of an expansion valve and evaporator coil in order to maintain a temperature setpoint.

In containerized refrigerated cargo it is desirable to maintain the delivery air temperature very close to a predetermined temperature setpoint. While the setpoint could be maintained by periodically actuating and deactuating the refrigerant compressor, such a technique accelerates the wear on the starting coils of the electric motor of the compressor, and reduces the efficiency of the system. Consequently, a number of alternative techniques have been developed in the prior art for maintaining setpoint without the need for the frequent actuation of the compressor motor.

One prior art method is the throttling of return refrigerant as it enters the compressor. Such throttling reduces the flow of refrigerant and thus the cooling capacity. The desired temperature setpoint can be easily maintained if the throttling can reduce the cooling capacity of the system to the cooling required in the conditioned space.

While such a throttling technique works well when semi-hermetic or piston-type compressors are used to drive the refrigerant in the system, it does not work well when scroll-type compressors are used and when the cooling required becomes very small or even negative. In such a situation, the pressure within the housing of the scroll-type compressor can become low enough to cause arcing between the electrical terminals within such compressors, which in turn can destroy the compressor. And even in instances where the pressure drop is just short of causing such arcing, such throttling can interfere with the return of a sufficient amount of lubricating oil to the compressor while at the same time causing high compressor temperatures. Over time, these conditions can likewise result in the destruction of the compressor. While some scroll-type compressors have automatic unloading mechanisms to avoid damage under low pressure conditions, the triggering of such a mechanism invariably results in unwanted down-time as it is necessary to reset the mechanism and restart the compressor after the occurrence of every such triggering event.

To overcome the aforementioned shortcomings associated with setpoint control that relies upon suction throttling, refrigerant bypass techniques were developed. In one such technique, compressor discharge gas is routed downstream of the expansion valve directly to the evaporator coil, thus neutralizing at least some of the cooling created by gaseous refrigerant exiting the expansion valve. Unfortunately, this technique requires the use of a relatively expensive, high temperature modulation valve to regulate the flow of the relatively hot (i.e., 200° F.) refrigerant exiting the compressor. It further requires the use of a specially-designed side port discharge distributor to prevent the introduction of bypassed gas from interfering with the uniform distribution of refrigerant through all the various evaporator coil inlets.

Clearly, there is a need for an improved technique for maintaining a desired temperature setpoint in a refrigeration system that utilizes a scroll-type compressor. Ideally, such a technique would be easily retrofittable upon existing refrigeration systems, and capable of accurately maintaining a desired setpoint without the need for high temperature valves or specially designed refrigerant discharge distributors.

SUMMARY OF THE INVENTION

Generally speaking, the invention is a temperature control system and method for a refrigeration circuit that overcomes all of the aforementioned shortcomings. Both the system and the method are applicable to a refrigeration circuit of the type that includes a compressor for compressing a refrigerant, a condenser coil for receiving compressed gaseous refrigerant from the compressor and converting it into a liquid, a receiver tank for collecting liquid refrigerant from the condenser coil, an expansion valve downstream of the condenser coil for expanding the liquid refrigerant into a gas, an evaporator coil downstream of the expansion valve for receiving the expanded, gaseous refrigerant from the expansion valve, and a modulation valve downstream from the evaporator coil for throttling the refrigerant flow.

The system of the invention includes a conduit for conducting a bypass flow of saturated, gaseous refrigerant from the receiver or other point in the circuit downstream of the condenser coil to a point between the evaporator coil and the modulation valve. In one embodiment of the invention, the valve mechanism includes a solenoid operated valve for opening and closing the conduit conducting the bypass flow, and a fixed diameter orifice for regulating the resulting flow. In another embodiment, the valve mechanism includes a valve element whose position is adjustable, in analog fashion, to vary the bypass flow of saturated, gaseous refrigerant through the conduit. Both embodiments modulate the flow of saturated gaseous refrigerant to augment the control system in achieving a desired temperature setpoint.

The system may further include a microprocessor having an input connected to a temperature monitoring means, and an output connected to the valve mechanism. The temperature monitoring means generates an electrical signal indicative of the temperature of a space conditioned by the refrigeration system, and the output of the microprocessor either opens or shuts the solenoid operated valve of the first embodiment, or varies the position of the valve element of the second embodiment in order to adjust the flow of saturated, gaseous refrigerant to achieve the desired setpoint.

The method of the invention comprises the step of conducting a flow of saturated, gaseous bypass refrigerant from a point in the circuit downstream of the condenser coil to a point downstream of the evaporator coil to partially counteract the cooling of the evaporator coil from the expanding refrigerant. The flow of saturated, gaseous refrigerant is preferably tapped off from an upper portion of the receiver tank. The preferred method of the invention includes the additional steps of monitoring the temperature of the space conditioned by the refrigeration system, comparing the space temperature to a selected setpoint temperature, modulating the refrigerant flow to the compressor, and modulating the flow of saturated, gaseous refrigerant to maintain and monitor the temperature of the space to within a selected temperature range that includes the selected setpoint.

Both the system and the method provide a novel means of bypass temperature control for a refrigeration circuit that does not require the use of expensive, heat-resistant valves, or special refrigerant distributors between the expansion valve and the evaporator coil.

DETAILED DESCRIPTION OF THE PREFERRED EMBODIMENTS

Figure 1:
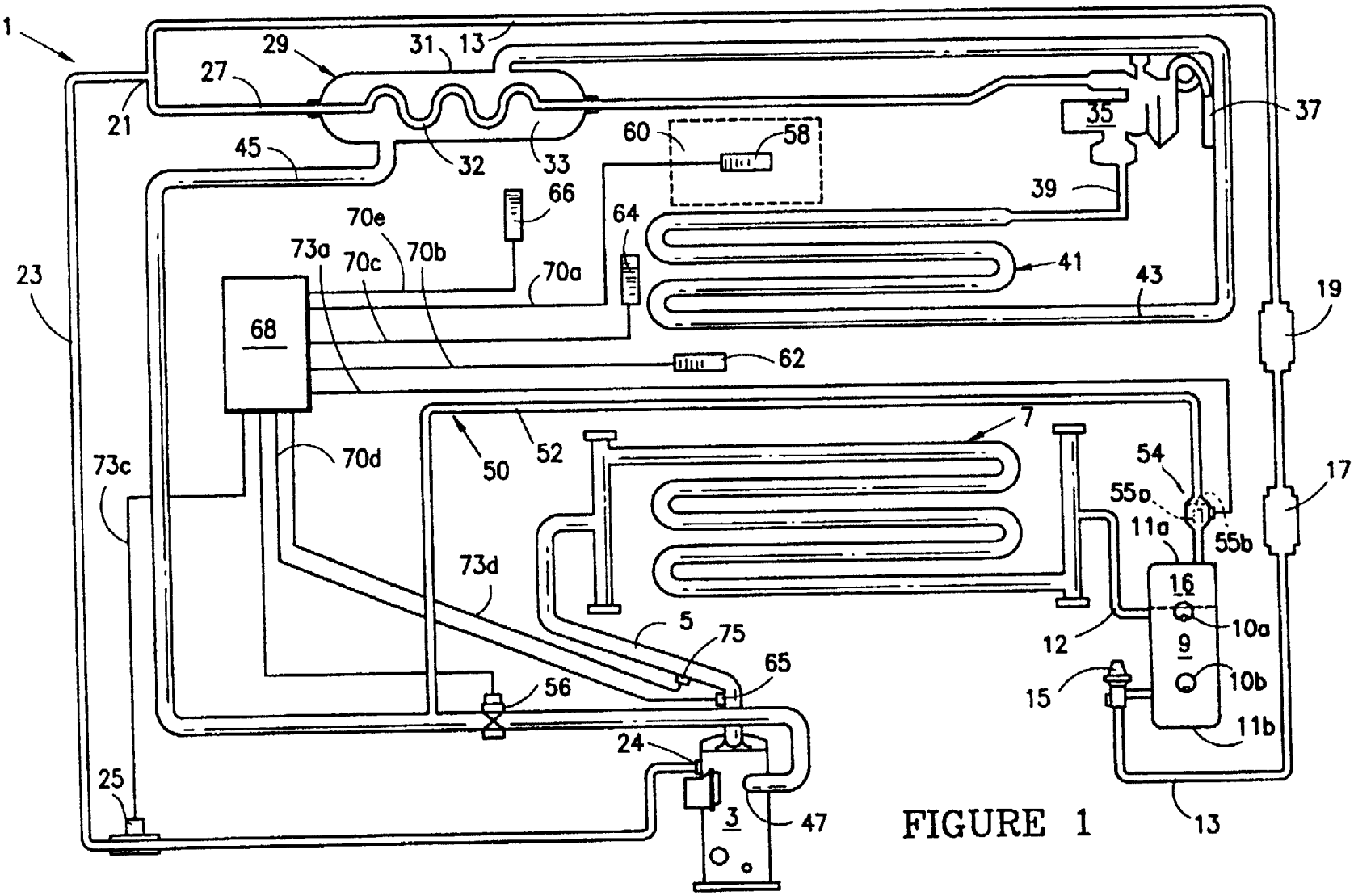
FIG. 1 schematically illustrates a refrigeration circuit that includes the bypass control system of the invention.

With reference now to FIG. 1, the control system and method of the invention is well adapted for use in a refrigeration circuit 1 of the type that uses a scroll-type compressor 3. The compressor 3 includes a refrigerant outlet conduit 5 that is connected to a condenser coil 7. The condenser coil 7 cools hot, gaseous refrigerant received from the compressor 3 and converts it into a liquid state. A receiver tank 9 is provided at the outlet end of the condenser coil 7 to collect liquified refrigerant. Sight glasses 10*a,b* are provided at upper and lower portions 11*a,b* of the tank 9. Receiver tank 9 further includes an inlet conduit 12 at its upper portion 11*a* for receiving liquified refrigerant from the condenser coil 7, and an outlet conduit 13 at its lower portion 11*b* for conducting this liquified refrigerant to the rest of the circuit 1. An outlet valve 15 is provided in the outlet conduit 13 for closing off the flow of liquid refrigerant from the receiver tank 9, as may be necessary during a maintenance operation. It is important to note that gaseous, saturated refrigerant 16 is always present in the upper portion 11*a* of the receiver tank 9 above the liquid refrigerant contained within the tank 9.

Outlet conduit 13 includes both an oil filter 17 and a filter dryer 19 for filtering the oil and removing water from the liquid refrigerant, respectively. Outlet conduit 13 terminates in a T-joint 21 that connects it with a compressor cooling conduit 23, and a heat exchanger conduit 27. The compressor cooling conduit 23 conveys liquid refrigerant to an injection inlet port 24 of the compressor 3 in the event that the compressor 3 overheats. A liquid injection valve 25 opens the conduit 23 in the event that the discharge temperature of the refrigerant exceeds 280° F. The injection port 24 includes a small orifice (not shown) that converts liquid refrigerant from conduit 23 into gaseous refrigerant that cools the compressor 3 under such overheated conditions.

However, under normal operating conditions, valve 25 is closed and a liquid refrigerant flows through the heat exchanger conduit 27. Conduit 27 directs liquid refrigerant through a heat exchanger 29 that functions to cool the refrigerant before it enters expansion valve 35. To this end, the heat exchanger 29 includes a cylindrical jacket 31 that surrounds a heat exchange coil 32. As will be explained in more detail hereinafter, the cylindrical jacket 31 contains a flow of gaseous refrigerant from the outlet end of the evaporator coil of the system 1 that cools the liquid refrigerant as it circulates through the coil 32.

Cooled, liquid refrigerant leaving the heat exchanger 29 is conducted into the expansion valve 35 via conduit 27. Expansion valve 35 includes a temperature sensor 37 connected to the outlet conduit of the evaporator coil 41 for adjusting the position of the valve 35. Expansion valve 35 functions in the conventional manner to convert liquid refrigerant to gaseous refrigerant in order to cool the evaporator coil 41. A fan (not shown) in turn circulates air through the coil 41 and into a conditioned space 60. A valve outlet conduit 39 connects the outlet of the valve 35 to the evaporator coil 41. A coil outlet conduit 43 connects the outlet of the evaporator coil 41 to the jacket 31 of the heat exchanger 29 so that cool, gaseous refrigerant cools the liquid refrigerant flowing through coil 32. Finally, a jacket outlet conduit 45 connects the heat exchanger jacket 31 to the suction line modulation valve 56 and the compressor inlet 47 as shown to allow the gaseous refrigerant exiting the evaporator coil 41 to recirculate.

The bypass control system 50 of the invention includes a bypass conduit 52 having an inlet connected to the upper portion 11*a* of the receiver tank 9, and an outlet connected to the jacket outlet conduit 45 leading to the compressor inlet 47. The control system 50 further includes a bypass actuation valve 54 near the inlet of the conduit 52. In one embodiment of the invention, the valve mechanism 54 comprises a variable flow valve that can modulate a flow of refrigerant through the bypass conduit 52 in analog fashion by means of a variable positionable valve element 55*a*. In another embodiment of the invention, the modulation valve mechanism 54 includes merely an orifice plate 55*b* that allows a measured flow of refrigerant to flow through the conduit 52 whenever the valve mechanism 54 is opened. In this last embodiment, modulation is more approximately achieved in digital fashion by completely opening or completely closing valve 54.

The control system 50 further includes a variety of temperature sensors for monitoring the temperature at key points within the refrigeration circuit 1. Specifically, the system 50 includes a return air temperature sensor 58 that measures the temperature of return air circulating from a space 60 that is conditioned by the circuit 1, as well as a discharge air temperature sensor 62 that measures the temperature of air discharged through the evaporator coil 41 via a fan (not shown). A sensor 64 is also provided for measuring the temperature of the evaporator coil 41. Finally a sensor 66 for measuring the temperature of the ambient air is provided. Each of the these sensors 58, 62, 64, 65, and 66 generate an electrical signal that is conducted to the input of a microprocessor 68 via wires 70*a–e*, respectively. The microprocessor 68 further includes an output that is connected to the modulation valve mechanism 54, the suction line 56, the liquid injection valve 25, and a condenser fan pressure switch 75 via wires 73*a–d*, respectively.

In operation, the microprocessor 68 is programmed to maintain the temperature of the conditioned space 60 to a particular setpoint. After the temperature setpoint is attained, the compressor 3 continues to operate while the microprocessor periodically opens the bypass solenoid valve 54 in order to reduce the cooling capacity of the circuit 1 so that the continued running of the compressor 3 does not draw the conditioned space 60 down to a temperature that is significantly less than the setpoint temperature. In the event that the valve mechanism 54 is a modulation valve, the microprocessor 68 will vary the position of the valve element 55*a* in analog fashion in order to maintain temperature setpoint as measured by sensor 58. If the valve mechanism 54 is merely the combination of an on-off valve and an orifice plate 55*b*, then the microprocessor will periodically open and close the valve mechanism 54 in digital fashion in order to maintain setpoint. At all times, the refrigerant conducted through the bypass conduit 52 is in a gaseous state, being drawn out of the top of the receiver tank 9 from the saturated, gaseous refrigerant 16 that is constantly present at the upper portion 11*a* of the tank.

What is claimed:

1. A temperature control system for a refrigeration circuit that includes a compressor for compressing a refrigerant, a condenser coil for receiving compressed gaseous refrigerant from the compressor and converting it into a liquid, an expansion valve downstream of said condenser coil for expanding liquid refrigerant from the condenser coil into a gas, an evaporator coil downstream of said expansion valve for receiving the expanded, gaseous refrigerant from the expansion valve, and a suction modulating valve downstream of the evaporator coil comprising:

means for selectively conducting a flow of saturated, gaseous refrigerant from a point in said circuit downstream of said condenser coil to a point between said evaporator coil and said suction modulation valve to partially counteract the cooling of the evaporator coil from said expanding refrigerant, and means for monitoring the temperature of a space conditioned by said evaporator coil, and said conducting means includes a means for modulating said flow of saturated, gaseous refrigerant to achieve a selected setpoint temperature in said conditioned space.

2. The system of claim 1, wherein said compressor of said circuit is a scroll-type compressor.

3. The system of claim 1, wherein said refrigeration circuit further includes a receiver tank for collecting liquid refrigerant from said condenser coil, and said conducting means includes a conduit having one end connected to an upper portion of said tank for receiving saturated, gaseous refrigerant, and another end for conducting said saturated, gaseous refrigerant between said evaporator coil and said suction modulation valve.

4. The system of claim 3, wherein said conduit of said conducting means includes a valve mechanism for modulating said flow of saturated, gaseous refrigerant to achieve said temperature setpoint.

5. The system of claim 4, wherein said valve mechanism includes a solenoid operated valve for opening and closing said conduit to said flow of saturated, gaseous refrigerant, and a fixed diameter orifice for regulating said flow.

6. The system of claim 4, wherein said valve mechanism includes a modulation valve having a valve element for varying resistance to said flow of saturated, gaseous refrigerant.

7. The system of claim 4, further comprising a microprocessor means having an input connected to said temperature monitoring means, and an output connected to said valve mechanism for controlling said valve mechanism in response to a signal generated by said monitoring means.

8. A temperature control method for a refrigeration circuit that includes a compressor for compressing a refrigerant, a condenser coil for receiving compressed gaseous refrigerant from the compressor and converting it into a liquid, an expansion valve downstream of said condenser coil for expanding liquid refrigerant from the condenser coil into a gas, an evaporator coil downstream of said expansion valve, and a suction line modulating valve for throttling refrigerant flow through said compressor, comprising the steps of:

conducting a flow of saturated, gaseous refrigerant from a point in said circuit downstream of said condenser coil to a point downstream of said evaporate coil to partially counteract the cooling of the evaporator coil from said expanding refrigerant, monitoring the temperature of a space conditioned by said refrigeration system, comparing said space temperature to a selected setpoint temperature, and modulating said flow of saturated, gaseous refrigerant to maintain the monitored temperature of said space to within a selected temperature range that includes said selected setpoint.

9. The method of claim 8, wherein said circuit further includes a receiver tank downstream of said condenser coil for accumulating liquid refrigerant, and wherein said flow of saturated, gaseous refrigerant originates from an upper portion of said tank.

10. The method of claim 8, wherein said compressor of said circuit is a scroll-type compressor.

11. The method of claim 8, wherein said conducting step is implemented by opening and closing a valve mechanism to intermittently conduct said flow of saturated, gaseous refrigerant through a fixed diameter orifice.

12. The method of claim 8, wherein said conducting step is implemented by varying the position of a valve element in a valve mechanism to modulate the amount of said flow of saturated, gaseous refrigerant to said point between said evaporator coil, and said suction modulating valve.

* * * * *